US005347671A

United States Patent [19]

Hunts

[11] Patent Number: 5,347,671

[45] Date of Patent: Sep. 20, 1994

[54] BAG OPENING AND RECLOSING DEVICE

[76] Inventor: Larry D. Hunts, 1111 Netherlands Rd., Trail, Oreg. 97541

[21] Appl. No.: 947,676

[22] Filed: Sep. 17, 1992

[51] Int. Cl.[5] ..... B65P 33/16; B67B 7/00; B25F 1/00

[52] U.S. Cl. ..... 7/156; 7/158; 30/DIG. 3; 30/2; 24/30.5 R

[58] Field of Search ..... 7/158, 170, 113, 151, 7/156; 24/3 M, 17 AP, 17 B, 129 D, 300, 30.5 R, 30.5 S, 30.5 T; 30/2, 123, 124, DIG. 3, 278, 280, 314

[56] References Cited

U.S. PATENT DOCUMENTS

| | | | |
|---|---|---|---|
| D. 317,571 | 6/1991 | Henriksson . | |
| 596,150 | 12/1897 | Fitch . | |
| 2,420,460 | 5/1947 | Bowdoin et al. | 30/2 |
| 2,854,717 | 10/1958 | O'Farrell et al. | 24/30.5 R |
| 3,066,846 | 12/1962 | Domigan | 24/30.5 R |
| 3,266,711 | 5/1965 | Song . | |
| 3,629,905 | 12/1971 | Cote . | |
| 4,296,529 | 10/1981 | Brown . | |
| 4,414,717 | 11/1983 | Payne | 24/30.5 R |
| 4,514,902 | 5/1985 | Stewart | 30/2 |
| 4,570,339 | 2/1986 | Taylor | 30/2 |
| 4,580,342 | 4/1986 | Beuzart | 30/2 |
| 4,599,758 | 7/1986 | Stiles | 30/2 |
| 4,986,000 | 1/1991 | Mills | 30/2 |
| 5,000,747 | 3/1991 | Cardo | 24/30.5 S |
| 5,007,171 | 4/1991 | Horning, Jr. . | |

FOREIGN PATENT DOCUMENTS

| | | | |
|---|---|---|---|
| 0684164 | 3/1930 | France | 24/30.5 T |

*Primary Examiner*—Roscoe V. Parker
*Attorney, Agent, or Firm*—Olson & Olson

[57] ABSTRACT

A bag opening and resealing device is formed of a longitudinally elongated body member having a longitudinally extending bag-receiving slot that extends from one end of the body, where the slot is flared to facilitate entry of a bag to be cut, and terminates inwardly of the opposite end of the body. Perpendicular to the slot, the body is provided with a guide slot which terminates inwardly of the opposite ends of the body and extends transversely through the body, and a knife holder is received slidably in the guide slot and mounts a knife blade in position to intercept the bag-receiving slot, wherein, with a bag contained in the bag-receiving slot, movement of the knife holder along its guide slot effects cutting of the bag. Further, with a bag received within the bag-receiving slot, the body may be rotated in order to wrap a portion of the bag tightly about the body member where it is secured in its tightly wrapped, sealed condition by an elastic band stretched over the roll and secured to opposite ends of the body member to prevent loosening or unwinding of the bag on the base member.

6 Claims, 4 Drawing Sheets

BAG OPENING AND RECLOSING DEVICE

BACKGROUND OF THE PRIOR ART

This invention relates primarily to a device arranged to facilitate the opening and reclosing of flexible bags, tubes and the like, and more particularly to a novel device that is configured to serve both functions while providing a simplified construction with a resulting simplified operation for reliability and ease of use.

The packaging of materials and products in flexible bags and tubes has long been considered a practical and efficient method of packaging. Everything from building materials to snacks come in bags nowadays, and yet the age old problem of opening the bags and temporarily resealing them between uses has only seemed to become worse over time particularly with the introduction of new packaging materials and methods. One of the most widely recognized truisms in the art is that the difficulty of opening and resealing a bag nowadays is directly proportional to how fragile the contents of the bag are.

Virtually everyone, for example, has experienced the oft times comical exercise of trying to open a bag of potato chips, and the near absolute mutilation of the bag and its contents that invariably results when those bags are opened by hand without a cutting tool of some sort. Moreover, it is widely recognized that the materials being used in bag construction have the additionally frustrating characteristic of a highly developed "memory" that virtually defies remaining in a rolled up condition between uses so that the contents are kept away from exposure to air. In short, a growing problem exists where, if one is able to successfully open a bag so that it remains in a condition in which it may be rolled up in order to reseal the contents between uses, it won't stay rolled up for very long.

Various devices have been provided heretofore in the art that attempt to address these problems, typical of which are illustrated in U.S. Pat. Nos. 596,150; 3,266,711; 3,629,905; 4,296,529; 4,360,970 and 5,007,171, the first four relating to bag closing devices, and the final two relating to bag opening devices. All of the bag closing devices however ignore the more reliable and secure method of sealing a bag by rolling its open end up, and instead provide constructions which attempt to maintain an airtight and secure seal by simply pinching or clamping the mouth of the bag closed. The opener devices that are known simply provide blade-holding devices through which the upper portion of a bag is drawn so as to cut its sealed top edge off.

SUMMARY OF THE INVENTION

In its basic concept, this invention provides a wrapping tool for bags and the like, the tool configured to receive the end portion of a bag or the like and be rotated about its longitudinal axis in order to wrap a portion of the bag into a releasably lockable, tight roll about the tool, whereby, for example, an open bag may repeatedly be positively and securely resealed in order to prevent inadvertent spillage, premature spoilage or undesirable exposure to air and moisture.

It is by virtue of the foregoing basic concept that the principal objective of this invention is achieved; namely, the provision of a bag wrapping apparatus that utilizes the tight rolling of the bag material itself to form a strong and positive airtight closure, and thereby avoid the limitations and disadvantages of the previous closure constructions.

Another object and advantage of this invention is the provision of a bag wrapping device of the class described which may include a cutting blade assembly to facilitate initial opening of a bag and for trimming unwanted, excess bag material before resealing as the contents of the bag are depleted.

Another object of this invention is the provision of a bag wrapping device of the class described which is adaptable to a wide and diverse range of bags and the like without significant modification.

A still further object of the present invention is the provision of a bag wrapping device of the class described which is of simplified construction for economical manufacture and simplicity and reliability of use.

The foregoing and other objects and advantages of this invention will appear from the foregoing detailed description, taken in connection with the accompanying drawings of preferred embodiments.

DESCRIPTION OF THE PREFERRED EMBODIMENT

Figures 1, 2:
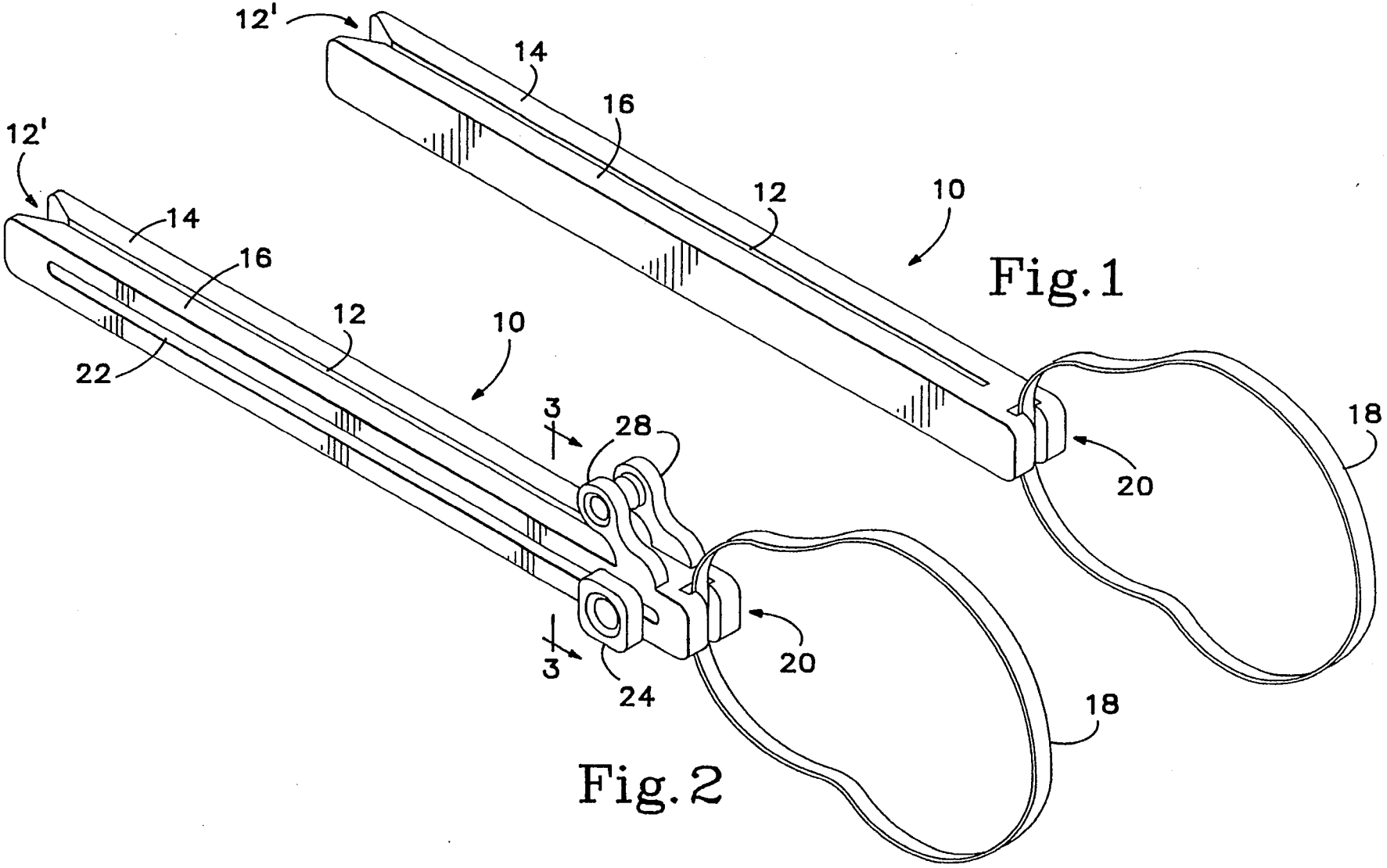
FIG. 1 is a perspective view of a bag sealing apparatus embodying the basic features of this invention.
FIG. 2 is a perspective view of a bag sealing apparatus configured with a sliding blade cutter arranged to open bags and trim excess, unwanted bag material that is formed as the contents of the bag are used up.
Figure 5:
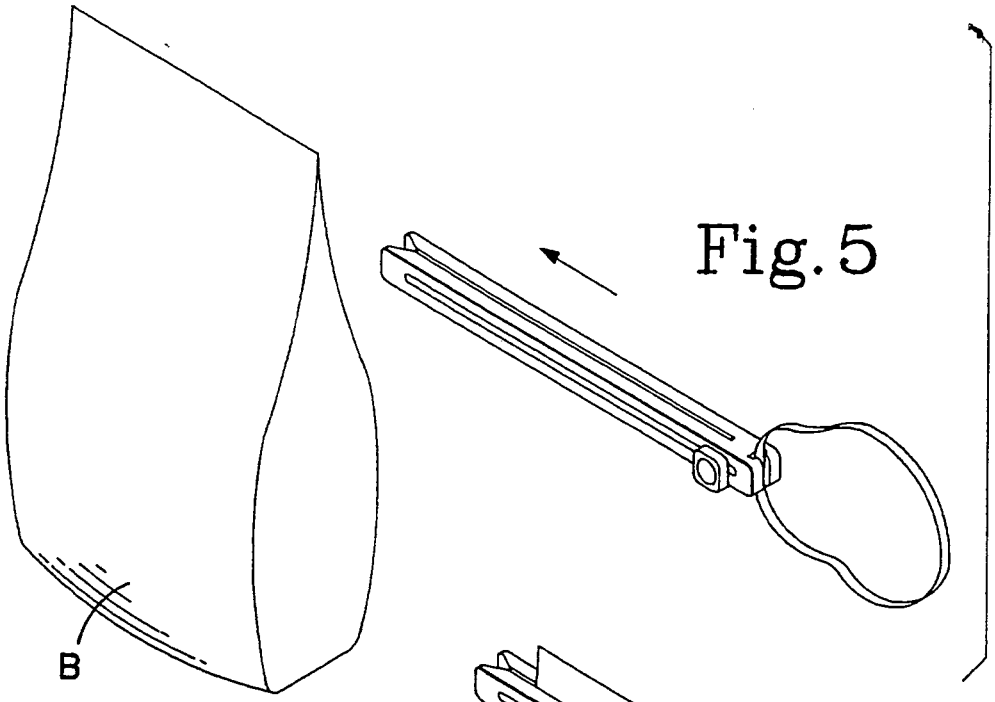
FIGS. 5—11 are schematic, perspective views illustrating the operation of the present invention in opening or trimming a bag and resealing a bag after it has been opened.
Figure 6:
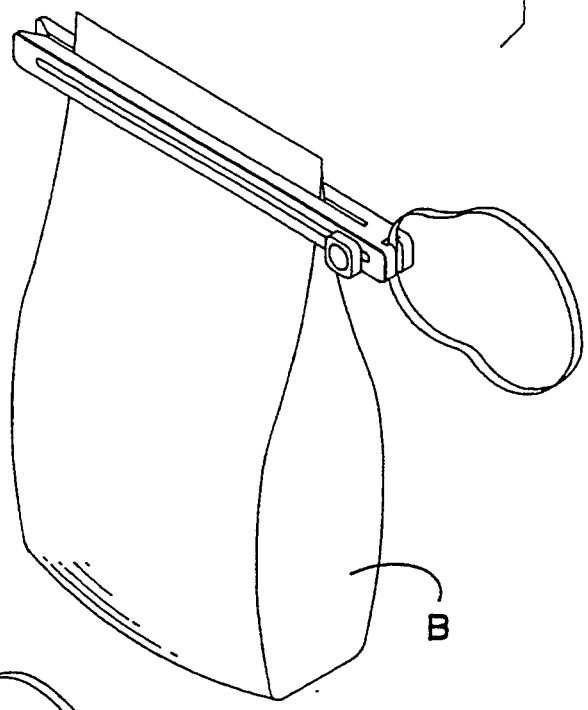

FIG. 1 of the drawings illustrates a bag sealing device that embodies the basic features of the present invention. A longitudinally elongated base member 10 is provided with a longitudinally extending, bag-receiving slot 12, open at one of its longitudinal ends 12', the slot extending transversely through the body of the base member effectively forming two spaced apart finger members 14, 16 between which a portion of a bag B may be inserted as seen in FIGS. 5 and 6. The opposing finger members provide means to confine the flexible walls of the bag during the operations that will be explained later.

The base member may be formed of any suitable material by any conventional method that is appropriate. Although it is not necessary in most cases, it is preferable that the base member be configured of sufficient length to receive the entire width of a bag within the bag-receiving slot. As illustrated, for convenience, the base member is preferably configured so that the open end of the bag-receiving slot is flared somewhat to facilitate the entry of bag into the slot.

Figure 11:
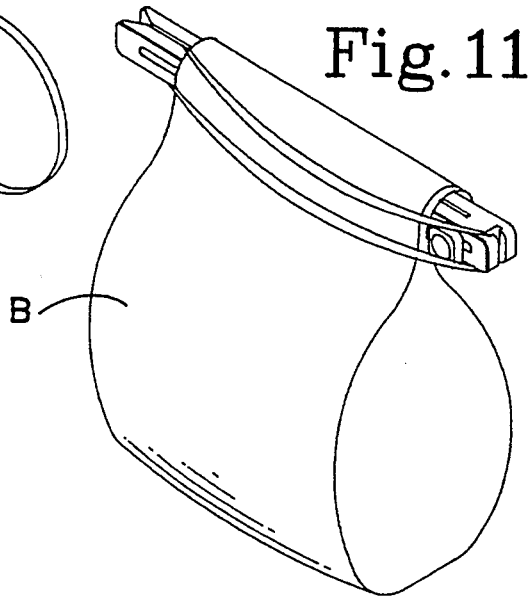

As will be understood by viewing FIGS. 8–11 of the drawings, the bag sealing operation of the present invention is readily apparent and easily understood. The upper portion of an open bag is entered into the bag receiving slot 12 of the base member and moved fully into the confines of the slot as in FIG. 9. The base member is then rotated about its longitudinal axis a desired number of turns to wrap the bag into a tight roll about the base member forming an airtight closure of the bag. Securing means is provided on the base member to releasably engage the bag and retain it in its fully wrapped condition on the base member. In the embodiments of FIGS. 1 and 2, and the operational figures of FIGS. 5–11, securing means is provided by an elastic band 18 which is secured by any suitable means to the closed end 20 of the base member opposite the open end identified at 12'. As illustrated in FIG. 11, once the bag has been sufficiently wrapped onto the base member, the elastic band is stretched across the wrapped portion of the bag and attached to the opposite end of the base member, as by directing it into the slot 12 as shown. The tension of the overlying elastic band prevents any loosening or unwrapping of the bag on the base member.

It is important here to note that a very distinguishing and valuable advantage of the method and apparatus of the present invention over the prior art constructions is readily apparent in viewing FIG. 11 of the drawings. Specifically, the repeated wrappings of the bag to form a tight roll results in an extremely strong, airtight seal that is virtually unbreakable in its rolled condition and forms the strongest part of the bag. This tremendously strong airtight seal however is maintained by an extremely simple securing means that need only be configured to prevent simple unrolling of the bag. Whereas in the prior art devices, the weight of the contents of an upended bag, an explosive increase in the internal air pressure of a bag suddenly pressed on, or simple inadvertent dislodging of the earlier clamping devices can cause failure of their simple clamping functions, the present invention simply is not effected by any such conditions and can only release its seal if the securing means is physically released and the assembly is rotated in the reverse direction to unroll the bag. Accidental failure of the seal is thus virtually eliminated even under extreme conditions of abuse or accident since the present invention need only prevent the bag from unwrapping.

Figure 4:
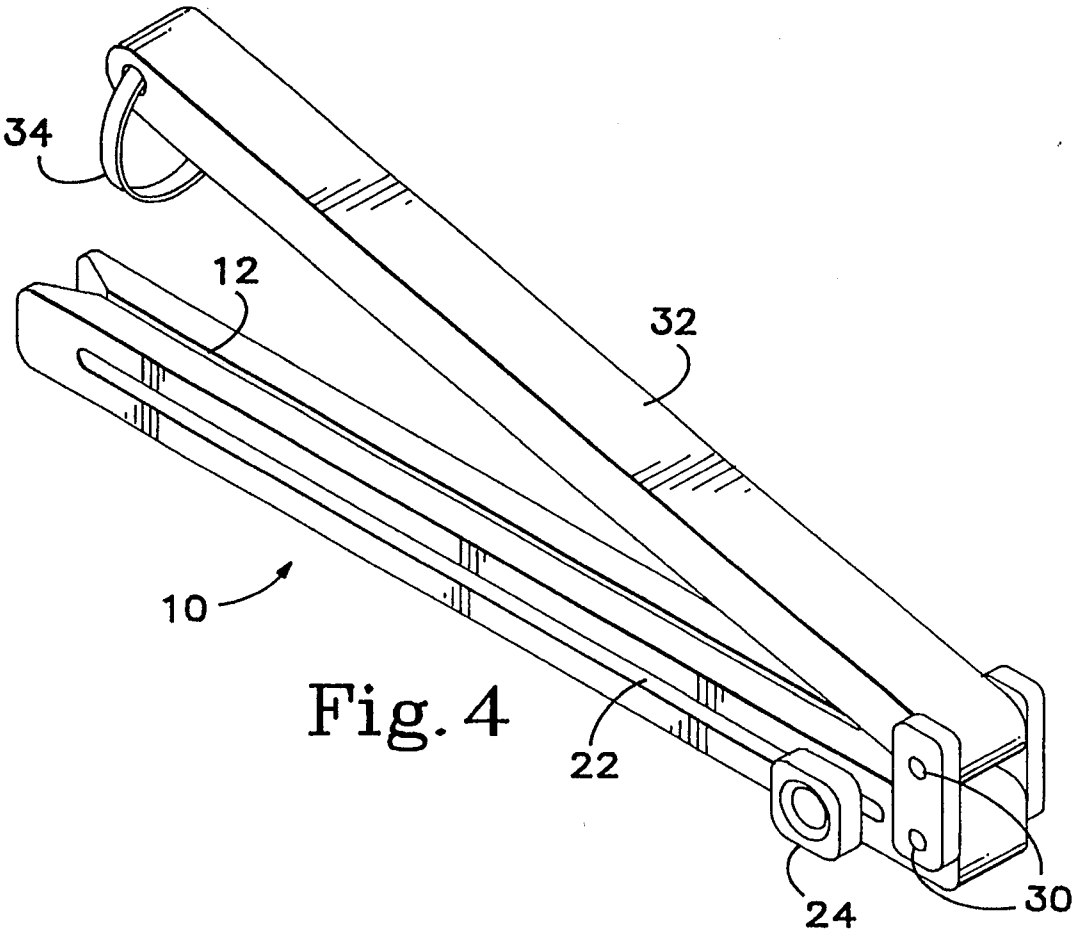
FIG. 4 is a perspective view of another embodiment of the bag sealing apparatus of this invention illustrating an alternative locking arrangement configured to releasably secure the bag in tightly wound condition on the tool.
Figure 3:
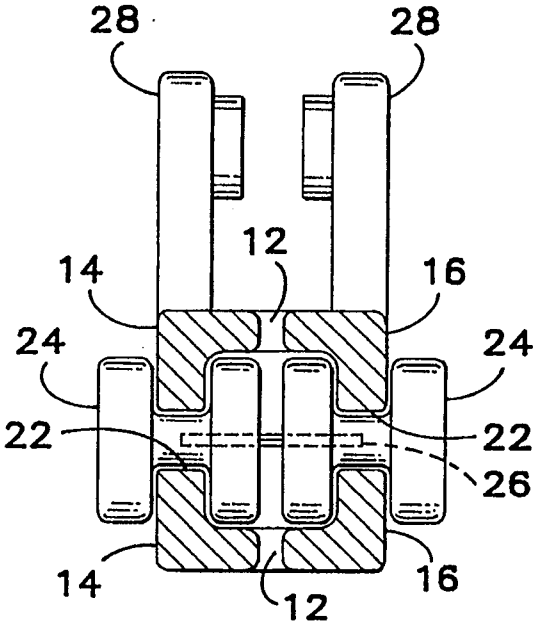
FIG. 3 is a sectional view through the bag sealing apparatus of FIG. 2 showing the cutter assembly, the view taken along the line 3—3 in FIG. 2.

The bag sealing apparatus may also include, as illustrated in the embodiments of FIGS. 2, 3 and 4, bag cutter means configured to trim excess and unwanted bag material that is created as the contents of a bag are used and would otherwise only encumber the wrapping operation of the invention. In the same manner, the apparatus of FIG. 2 may also be used to initially open sealed bags as well. As is apparent in comparing FIGS. 1 and 2, the base member 10 of FIG. 2 may include the same structural features as have been described in connection with the base member embodied in FIG. 1. Common reference numerals are therefore used to identify common structures.

Figure 7:
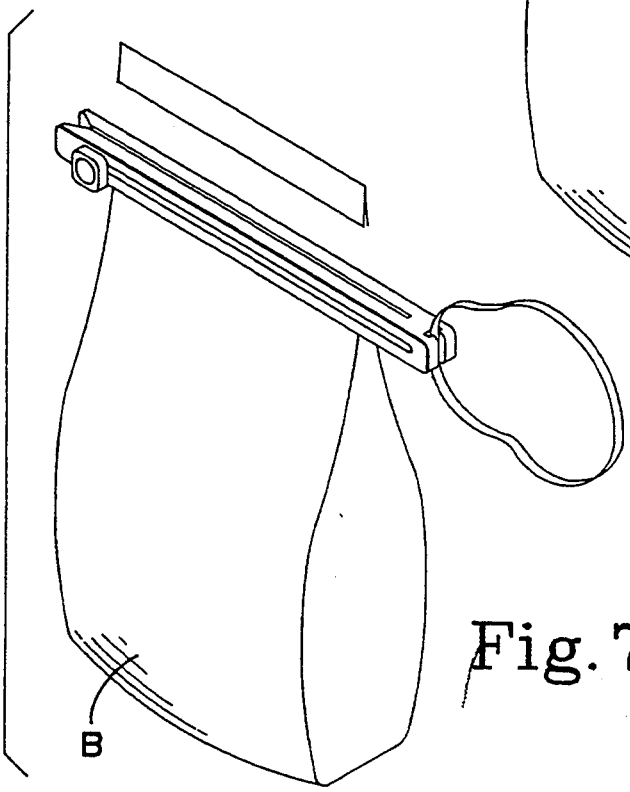

In this embodiment of the invention, the base member 10 operably mounts a bag cutter element that is arranged to cut off a desired portion of a bag extending through the slot 12 as seen in FIGS. 5–7. In this embodiment, perpendicular to the bag receiving slot 12, the base member is provided with a longitudinally extending guide slot 22 which terminates inwardly of the opposite longitudinal ends of the base member and extends transversely through the base member. A knife holder, illustrated in FIG. 2, is mounted slidably in the guide slots and a knife blade extends between the finger members 14, 16, intercepting the bag receiving slot. In this embodiment, the knife holder comprises a pair of slide members 24, substantially "H"-shaped in cross section, secured together in spaced apart condition by mutual attachment to a razor blade type knife element 26 as shown. Preferably, the space between the confronting surfaces of the slide members is approximately equal to the width of the bag-receiving slot 12 in order to prevent any bunching of the bag that might interfere with a smooth cutting operation. In the embodiment illustrated in FIG. 3, the interior confines of the base member have been hollowed out in order to accommodate the enlarged inner portion of the slide members contained therein. The outer enlarged portions of the slide members may be configured with a finger detent as shown in FIGS. 2 and 4 to improve their being grasped by an operator's fingers.

Figure 8:
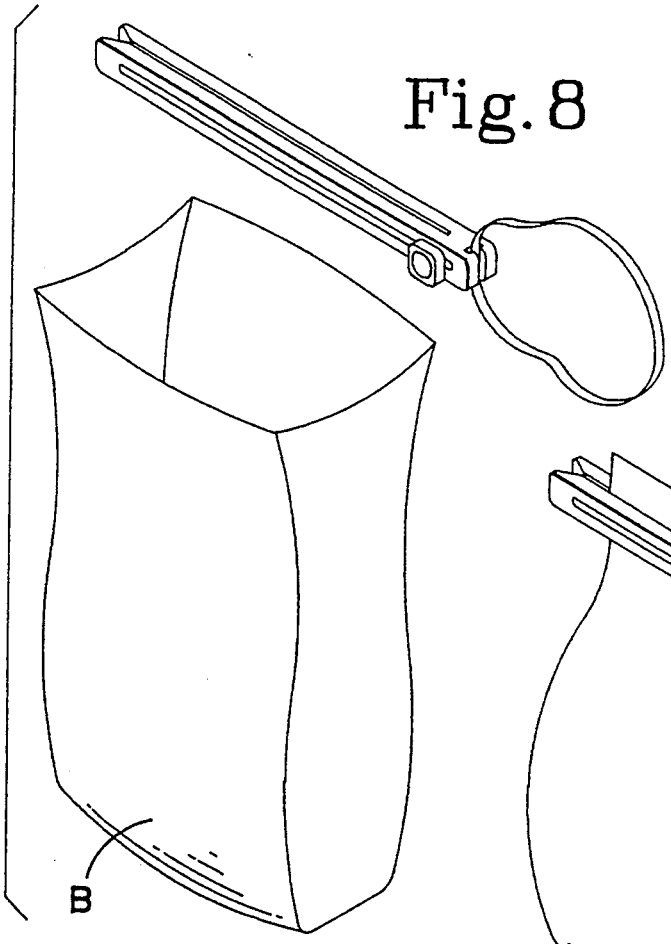
Figure 9:
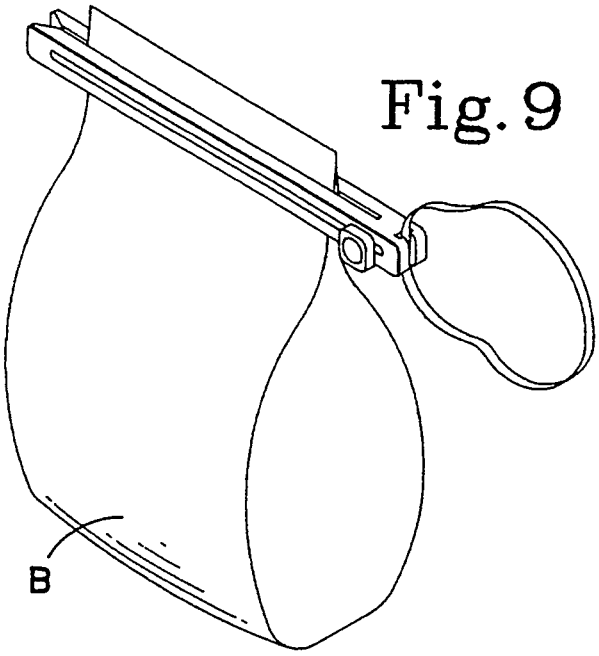
Figure 10:
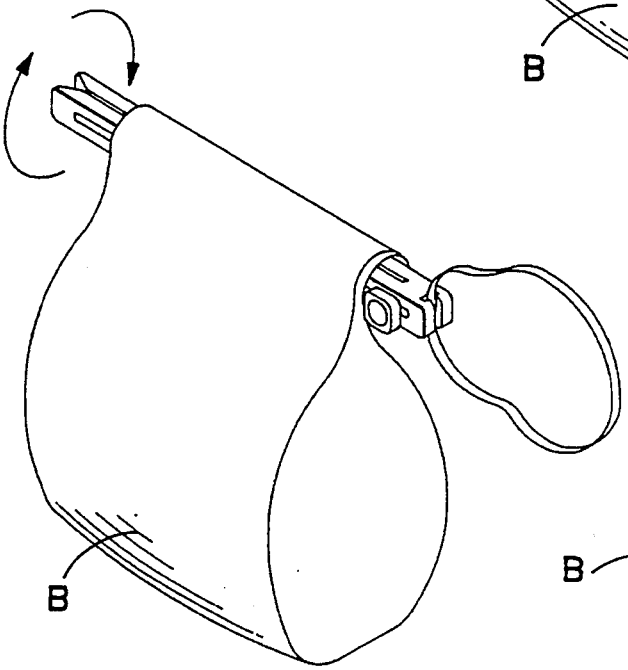

The trimming and opening operation of the invention is illustrated in FIGS. 5–8, wherein it is shown that the upper portion of a bag is inserted into the bag receiving slot 12 and, while the base member is held in place with one hand, the cutter assembly is moved along its guide slots 22, cutting a desired portion of the bag off, whereupon the base member is removed and the bag opened (FIG. 8).

FIG. 2 also illustrates the base member as mounting bag gripping means in the form of flexible finger tabs 28 which may be pinched together with the end portion of a bag thereinbetween to prevent inadvertent slippage of the bag during operation of the bag cutter previously described. Also, the finger tabs, in gripping the portion of the bag that is removed, prevents the nuisance of that small portion simply falling away to the floor after it has been severed from the bag.

FIG. 4 of the drawings illustrates an alternative bag securing means to the elastic band 18 configuration described earlier. In this embodiment, the base member 10 mounts by suitable hinge means such as pivot pin assembly 30 shown, a preferably resilient securing arm member 32 configured to overlie the last wrapping of the bag roll formed about the base member and be secured at its opposite end to the base member by a fastener means such as the elastic band 34 illustrated. This particular construction is believed to find particular utility in connection with very large, bulky or heavy bags more commonly found in industrial and commercial environments. On a smaller scale however, this particular construction finds versatility in connection with the continued wrapping of tubes such as those that contain tooth paste, in order to compact the material toward the nozzle end of the tube. The types of tubes that are used currently are notorious for their "memory" and their unyielding resistance to remaining in a wrapped condition. This particular securing means construction is ideally suited to accommodate the comparatively greater bulk and resistance of the tube wrappings that are contained on this necessarily rather small version of this invention.

This very positive type of securing means in conjunction with the rolled bag seal is also believed to be of particular value in the handling of contaminated and toxic materials such as materials and fluids, etc. awaiting disposal or destruction in hospitals, surgeries, medical and dental offices, mortuaries and embalmers, etc. When engineered to specific tolerances with carefully selected securing and fastening means, and proper bag materials are used, the extremely strong and positive bag seal that is created by this device can be of very important advantage to those persons handling such materials that could pose serious risk if exposure occurred.

From the foregoing it will be apparent to those skilled in the art that numerous changes can be made in the size, shape, type, number and arrangement of parts described hereinbefore, other than those changes already discussed and suggested, without departing from the spirit of this invention and the scope of the appended claims.

Having thus described my invention and the manner in which it is operated, I claim:

1. A sealing apparatus for releasably closing flexible bags, sacks, tubes and similar flexible containers, the sealing apparatus comprising:

a) a longitudinally elongated body member having a longitudinal bag-receiving slot therethrough, the slot extending from a point spaced inwardly of one longitudinal end of the body through the opposite terminal end of the body, thereby forming two spaced apart, opposite finger members between which a portion of a flexible bag can be received so that rotation of the body member in one direction about its longitudinal axis wraps a desired portion of the bag into a tight roll about the opposite finger members of the body member and subsequent rotation of the body member in the opposite direction unwraps the rolled portion of a bag from about the opposite finger members of the body member, and b) securing means mounted on the body member configured to releasably engage the outermost wrapping of a bag rolled about the opposite finger members of the body member for preventing loosening and unwrapping of the roll, said securing means comprising an elongated tension member mounted on one end of the body member and configured to be drawn over the outermost wrapping of a bag rolled about the opposite finger members of the body member and be secured releasably under tension to the opposite end portion of the body member, the tension member overlying the outermost wrapping of the bag roll in tensioned engagement therewith to prevent loosening and unwrapping of the roll.

2. The sealing apparatus of claim 1 wherein said tension member comprises an elastic band.

3. The sealing apparatus of claim 1 wherein the tension member comprises an elongated arm member pivotally mounted at one of its ends to one end of the body member and fastening means engages the opposite ends of said body member and said arm member to releasably secure the end of the arm member to the end of the body member, the arm member configured to overlie and engage the outermost wrapping of a bag rolled about the body member to prevent loosening and unwrapping of the bag roll.

4. The sealing apparatus of claim 1 including cutter means mounted on the body member configured to engage a bag received within said bag receiving slot and operable on the body member to cut off an end portion of the bag.

5. The sealing apparatus of claim 4 wherein said cutter means comprises a knife blade mounted slidably on the body member and disposed to intercept said bag receiving slot perpendicularly relative thereto, the knife blade movable longitudinally along the body member substantially the full length of the bag receiving slot.

6. A method of sealing a flexible bag, sack, tube or similar flexible container, the method comprising engaging a portion of a bag adjacent its open end between two spaced apart finger members of an elongated body member and rotating the body member to roll the bag tightly in successive wrappings thereabout, and firmly securing the outermost wrapping of the bag roll to the body member with an elongated tension member attached to opposite ends of the body member and overlying the outermost wrapping of the bag roll in tensioned engagement therewith to prevent loosening and unwrapping of the bag roll from about the body member.

* * * * *